United States Patent [19]

Vernam et al.

[11] 4,412,870

[45] Nov. 1, 1983

[54] WROUGHT ALUMINUM BASE ALLOY PRODUCTS HAVING REFINED INTERMETALLIC PHASES AND METHOD

[75] Inventors: William D. Vernam; Ralph W. Rogers, Jr.; Harry C. Stumpf, all of New Kensington, Pa.

[73] Assignee: Aluminum Company of America, Pittsburgh, Pa.

[21] Appl. No.: 219,573

[22] Filed: Dec. 23, 1980

[51] Int. Cl.[3] ..... C22F 1/04; C22C 21/06

[52] U.S. Cl. ..... 148/2; 148/11.5 A; 148/31.5; 148/439; 148/440

[58] Field of Search ..... 148/2, 11.5 A, 31.5, 148/32

[56] References Cited

U.S. PATENT DOCUMENTS

| | | | |
|---|---|---|---|
| 3,843,333 | 10/1974 | Woods | 29/191 |
| 3,926,690 | 12/1975 | Morris et al. | 143/32 |
| 4,002,502 | 1/1977 | Bainbridge et al. | 148/3 |
| 4,068,645 | 1/1978 | Jenkinson | 123/193 |
| 4,077,810 | 3/1978 | Ohuchi et al. | 148/2 |
| 4,126,448 | 11/1978 | Moore et al. | 75/146 |

FOREIGN PATENT DOCUMENTS

| | | | |
|---|---|---|---|
| 829816 | 12/1969 | Canada | 53/246 |

*Primary Examiner*—R. Dean

*Attorney, Agent, or Firm*—Andrew Alexander

[57] ABSTRACT

A wrought aluminum alloy product is disclosed. The alloy consists essentially of 0.5 to 10 wt. % Mg, 0.1 to 1.6 wt. % Mn, 0 to 0.35 wt. % Cr, at least 0.005 wt. % Sr, less than 1 wt. % Fe, 1 wt. % max. Si, 3.5 wt. % max. Zn, 1 wt. % max. Cu, the remainder aluminum and incidental impurities. The product is characterized by the presence of at least one intermetallic phase of the type containing Al-Fe-Si, Al-Fe-Mn and Al-Fe-Mn-Si, wherein at least one of such phases is refined.

74 Claims, 3 Drawing Figures

WROUGHT ALUMINUM BASE ALLOY PRODUCTS HAVING REFINED INTERMETALLIC PHASES AND METHOD

This invention relates to aluminum alloys and more particularly it relates to wrought aluminum alloy products such as sheet products suitable for forming into substrates for memory discs, for example.

In the fabrication of aluminum alloy substrates for memory discs, normally the substrates are machined usually on both sides prior to applying a coating thereto which functions as memory medium. It will be appreciated that for use as a memory disc substrate, the surface has to be extremely smooth in order not to interfere with the coatings and for storage of information therein. Normally, information is stored in such coating by electrical impulses or magnetized spots where presence or absence of such represent data and accordingly, it will be seen that irregularities in the surface can interfere with the ability of the coating to retain data accurately. The machining step referred to has not been without problems. For example, in some of the alloys used, insoluble constituents have presented problems from a machining standpoint, resulting in a high rejection rate for the substrates. That is, it has been found that in certain aluminum base alloys, insoluble constituents such as Al-Fe-Mn-Si constituents or phases, form in rather large particle sizes, sometimes greater than 1 micron, and interfere with the machining operation, particularly that required in the preparation of substrates for memory discs. These constituents can interfere with the machining operation by catching on the cutting tool and being removed therewith or being pulled across the machined surface leaving scratches. In either case, it adversely affects the smoothness desired. Further, it is believed that when a machined surface is etched, the large constituents interfere with uniformity of etching.

Even if the surface has been found to machine adequately, there can be instances where the coating or undercoating therefor is interfered with to an extent which affects storage of data in the coating. The interference is believed to result from relatively large intermetallic phases or constituents as noted above. Thus, it can be seen that such phases or constituents must be provided in a refined or modified condition which provides freedom from such conditions.

In addition, it has been found that such or similar problems can arise when aluminum-based alloys are anodized for use as bright trim on automobiles. That is, these intermetallic constituents can resist etching and anodization treatments resulting in holes or unanodized spots in the protective anodic coating which, of course, can severely interfere with the useful service life of the trim. Thus, again, it can be seen that it is very important to provide the intermetallic phases or insoluble constituents in a refined or modified condition which avoids these problems. Similarly, with fine wire forming, such as screen wire, the large particles interfere with the forming operation. That is, the large particles can cause severe breakage problems, in wire drawing. It will be understood that the problems referred to are used more for illustrative purposes and that there are many other applications where relatively large particles constituents interfere with the use of the particular aluminum alloy.

The present invention provides an aluminum base alloy wrought product having a refined or modified intermetallic phase or insoluble constituent which may be machined to a smoothness suitable for use as memory disc substrates, for example. In addition, aluminum base alloy products, e.g. extrusion or sheet products, in accordance with the invention have, inter alia, enhanced anodizing charcteristics.

Objects

A principal object of this invention is to provide an improved wrought aluminum base alloy product.

Another object of this invention is to provide a wrought aluminum alloy base sheet product having enhanced machining characteristics and being suitable for memory disc substrates.

A further object of this invention is to provide a wrought aluminum alloy base product characterized by refinement or modification of intermetallic phases.

And yet a further object of this invention is to provide a wrought aluminum alloy base sheet product having refined or modified intermetallic phases or insoluble constituents such as Al-Fe-Si, Al-Fe-Mn and Al-Fe-Mn-Si.

These and other objects will become apparent from the specification, drawings and claims appended hereto.

SUMMARY OF THE INVENTION

In accordance with these objects, a wrought aluminum sheet product suitable for machining and use as memory disc substrates is provided. The sheet product contains essentially 0.5 to 10 wt.% Mg, 0.1 to 1.6 wt.% Mn, 0 to 0.35 wt.% Cr, 0.005 to 2.5 wt.% Sr, less than 1 wt.% Fe, 1 wt.% max. Si, 3.5 wt.% max. Zn, 1 wt.% max. Cu, the remainder aluminum and incidental impurities and is characterized by at least one of refinement and modification of an intermetallic phase containing combinations of at least Al-Fe-Si or Al-Fe-Mn or Al-Fe-Mn-Si. That is, at least one of these phases of the type containing Al-Fe-Si, Al-Fe-Mn and Al-Fe-Mn-Si is refined.

DETAILED DESCRIPTION OF PREFERRED EMBODIMENTS

In certain aluminum base alloys, because of advances in the technology in which the alloy is used, it has become necessary to refine the constituent particle size in order to permit use of the new technology. For example, in disc-storage technology, efforts have been made to increase the amount of data which can be stored on a single disc and to change the medium traditionally used for storage purposes in order to circumvent problems. Efforts have been made to switch from iron oxide-type memory medium in order to increase the medium's resistance to erasure. Thin surface layers of cobalt, for example, have been investigated quite sucessfully to determine its suitability for such applications. Applications of a layer of memory medium such as iron oxide to an aluminum substrate involve different technology and thicker layers than that used for applying the thin layer of cobalt, for example. For instance, the iron oxide medium is applied to the substrate as a slurry or dispersed in a plastic binder, whereas plating or other forms of deposition, e.g. vapor or vacuum deposition, can be used for applying thin, metallic layers such as the thin cobalt layers. In addition, the thin metal films are very sensitive to defects on the surface of the aluminum substrate to which it is applied. For example, large constituent particles can interfere with the plating or deposition of the thin metallic layer. Also, as noted earlier, the large particles can interfere with the smoothness of the finish attainable on the aluminum substrate by machining, which in turn, is reflected in roughness of the thin metallic film deposited on the substrate. It must be remembered that particles, e.g. dust particles of about 0.3 micron, can interfere with the effectiveness of the head used for storing or reading data from the medium layer, particularly where the medium layer is comprised of a thin metallic layer. Accordingly, it can be seen why it is so important to minimize roughness on the surface of the aluminum substrate on which the layer is deposited.

Similarly, such problems with large constituent particles can be encountered in anodization of aluminum alloys used for auto trim for example. That is, the constituent particle on or near the surface can react or oxidize quite differently from surrounding material resulting in defects in the anodic coating. Such defects can adversely affect the corrosion resistance of the anodic coating on the trim. Thus, in the two examples given, it can be seen that such particles are best avoided.

Figure 1:
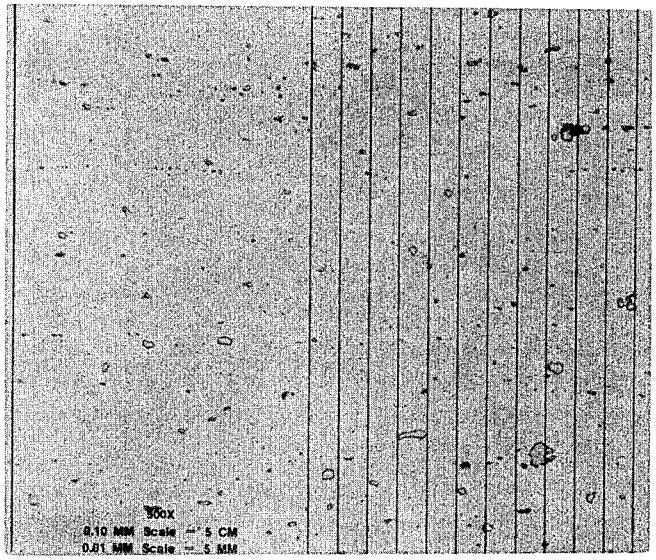
FIG. 1 is a photomicrograph (500×) of an aluminum base alloy sheet product showing constituent particles of Al-Fe-Mn-Si which interfere with machinability of the sheet.

FIG. 1 is a photomicrograph of an aluminum base alloy which had been used for memory disc substrates where the memory layer consisted particularly of iron oxide applied by the slurry method. In the micrographs, the distance between the vertical lines corresponds or represents 1 micron in the alloy microstructure. The alloy contains 0.11 wt.% Si, 0.37 wt.% Mn, 4.06 wt.% Mg, 0.08 wt.% Cr, 0.02 wt.% Zn, 0.20 wt.% Fe, 0.02 wt.% Cu, 0.01 wt.% Ti, the remainder aluminum and impurities. However, as can be seen from the micrograph, rather large Al-Fe-Mn-Si constituent particles occur throughout the metal. Some of the particles are on the order of about 1 micron which, as noted earlier, can interfere with machining and consequently with the memory medium.

Figure 2:
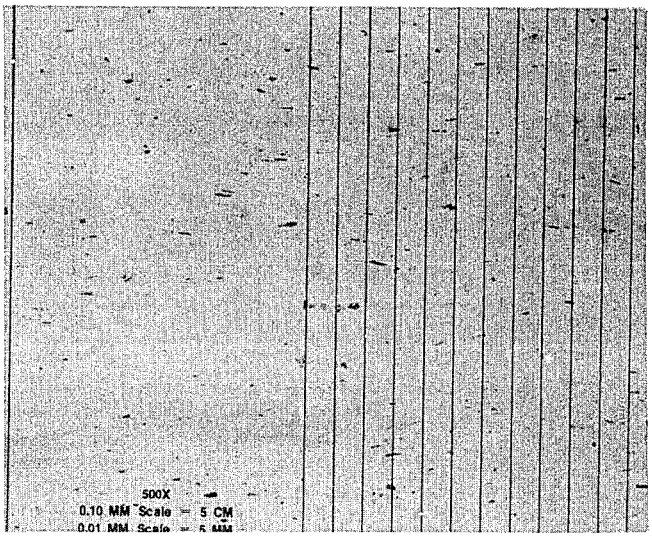
FIG. 2 is a photomicrograph (500×) of an aluminum base alloy sheet product of FIG. 1 having refined or modified constituent particles, the sheet product having improved machining characteristics and being particularly suitable for memory disc substrates.

FIG. 2 shows a photomicrograph of a wrought aluminum sheet product, particularly suitable for memory disc substrates, in accordance with the invention. The alloy of FIG. 2 contains 0.18 wt.% Si, 0.40 wt.% Mn, 3.85 wt.% Mg, 0.08 wt.% Cr, 0.033 wt.% Sr, 0.02 wt.% Zn, 0.22 wt.% Fe, 0.03 wt.% Cu, 0.01 wt.% Ti, the remainder aluminum and incidental impurities. Inspection of the micrograph reveals the absence of constituent particles having a size compared to that shown in FIG. 1. It is the freedom from relatively large particles which interfere with machining that provides the wrought sheet product shown in FIG. 2 with superior characteristics. Also, it is the absence of large particles which makes the product highly suitable for substrates such as those used in memory discs, particularly where the memory medium is a thin layer or film of metallic material which is plated or deposited on the substrate. Further, in compositions or alloys in accordance with the invention, the absence of such large particles makes the extrusion product, e.g. auto trim, as well as sheet product particularly suitable for anodizing. The sheet products of FIGS. 1 and 2 were rolled to 0.162-inch gauge. However, even when the sheet product of FIG. 2 is rolled to a sheet thickness of 0.082 inch gauge, it still retains its refined or modified structure, as can be seen by examination of the photomicrograph of FIG. 3.

When a wrought product in accordance with the invention is desired, the alloy can consist essentially of 0.5 to 10 wt.% Mg, 0.1 to 1.6 wt.% Mn, 0 to 0.35 wt.% Cr, 0.005 to 2.5 wt.% Sr, less than 1 wt.% Fe, 1 wt.% max. Si, 3.5 wt.% max. Zn, 1 wt.% max. Cu, the remainder aluminum and incidental impurities.

Magnesium is added or provided in this class of aluminum alloys mainly for purposes of strength and is preferably maintained in the range of 0.5 to 5.6 wt.%. Magnesium is also useful since it promotes fine aluminum grain size in the alloy which, of course, aids formability. It should be noted, though, that higher levels of magnesium can lead to fabrication problems. Thus, it becomes important to balance the strengths desired against problems in fabrication. With respect to machining, the higher levels of magnesium in solid solution favor machinability. Aluminum alloys having the poorest machining characteristics have a low alloy content and are usually in the annealed or softest condition. Conversely, increasing alloy concentration, cold work, solution and aging treatments, results in an improved surface finish by hardening the alloy, by reducing adherence of metal to the tools and by reducing the number of burrs. That is, these additions or treatments improve machinability. Thus, for purposes of machining aluminum alloy substrates for memory discs, it is desirable to maintain the magnesium in the range of about 3.5 to 5.5 wt.%. Where the application is aluminum screen wire, which is drawn to a very fine diameter, magnesium should be in the range of 4.5 to 5.6 wt.%, and where the application is aluminum easy-open-ends for beverage containers and the like, magnesium should be in the range of 4 to 5 wt.%. While higher levels of magnesium have been referred to for purposes of exemplification, lower levels of magnesium are also important in certain applications such as alloys used for rigid containers, auto trim, architectural products, trucks and railroad vehicles and are contemplated to be within the purview of the invention.

With respect to manganese, preferably it is maintained to less than 1 wt.%, and typically it is maintained in the range of 0.1 or 0.2 to 0.8 wt.%. Manganese is a dispersoid forming element. That is, manganese is an element which is precipitated in small particle form by thermal treatments and has, as one of its benefits, a strengthening effect. Manganese can form dispersoid consisting of Al-Mn, Al-Fe-Mn and Al-Fe-Mn-Si. Thus, in some magnesium-containing alloys where it is desired to increase corrosion resistance, magnesium can be lowered and manganese added at no loss in strength, but with increased resistance to corrosion. Likewise, chromium can have the advantage of increasing corrosion resistance, particularly stress corrosion. Also, chromium can combine with manganese to provide more dispersoid which, as noted earlier, can increase strength. Chromium can also have an effect by influencing preferred orientation with respect to earing, in cups for example. It will be understood that earing is detrimental because it results in wastage of metal. Preferably, chromium should not exceed 0.25 wt.% for most of the applications for which alloys of the invention may be used.

Solid solubility of iron in aluminum is very low and is on the order of about 0.04 to 0.05 wt.% in ingot. Thus, normally a large part of the iron present is usually found in aluminum alloys as insoluble constituent in combination with other elements such as manganese and silicon, for example. Typical of such combinations are Al-Fe-Mn, Al-Fe-Si and Al-Fe-Mn-Si. It will be appreciated that the elements in these combinations can be present in various stoichiometric amounts. For example, Al-Fe-Si can be present as $Al_{12}Fe_3Si$ and $Al_9Fe_2Si_2$ which are considered to be the most commonly occurring phases. Also, Al-Fe-Mn can be present as $Al_6(Fe_xMn_{1-x})$, where x is a number greater than 0 and less than B 1. With respect to Al-Fe-Mn-Si, this combination can be present as $Al_{12}(Fe_xMn_{1-x})_3Si$, where x is a number greater than 0 and less than 1. It should be noted that these constituents are considered to be the most common intermetallic phases found in these types of alloys. However, it should be understood that other elements such as Cu, Ti and Cr and the like can appear in or enter into the intermetallic phases referred to in minor amounts by substituting usually for part of the Fe or Mn. Such intermetallic phases are also contemplated within the purview of the invention. These insoluble constituents tend to agglomerate and form relatively large particles such as Al-Fe-Mn-Si constituents, as may be seen in FIG. 1, some of which are approximately 1 micron in length. As noted earlier, it is these larger, insoluble constituents that are so undesirable from the standpoint of machinability and formability. However, it must be remembered that iron has a beneficial effect as a grain refiner which, of course, aids machinability and formability. Further, it must be understood that iron is normally present in most aluminum alloys, mainly from an economic standpoint. That is, processing aluminum to remove iron for most applications is normally not economically feasible. Thus, many attempts have been made to work with iron in the alloy by taking advantage of its benefits and neutralizing its disadvantages often with only limited success. Thus, preferably, for purposes of the present invention, iron is maintained at 0.8 wt.% or lower, and typically less than 0.5 wt.%, with amounts of 0.4 wt.% or less being quite suitable.

Titanium also aids in grain refining and should be maintained to not more than 0.2 wt.%.

For purposes of the present invention, it is believed that the amount of silicon also should be minimized since, at relatively low levels it can combine with magnesium, resulting in significant strength reductions. Thus, preferably, silicon should be maintained at less than 0.5 wt.% and typically less than 0.35 wt.%.

Strontium, which should be considered to be a character-forming element, is also an important component in the alloys of the present invention. Strontium must not be less than 0.005 wt.% and preferably is maintained in the range of 0.005 wt.% to 0.5 wt.% with additional amounts not presently believed to affect the performance of the products adversely, except that increased amounts may not be desirable from an economic standpoint. For most applications for which alloys of the present invention may be used, strontium is preferably present in the range of 0.01 wt.% to 0.25 wt.%, with typical amounts being in the range of 0.01 wt.% to 0.1 wt.%.

The addition of strontium to the composition has the effect of refining or modifying intermetallic phases or insoluble constituents of the type containing Al-Fe-Si, Al-Fe-Mn and Al-Fe-Mn-Si as noted earlier. Because of the complex nature of these phases, it is not clearly known how this effect comes about. That is, because of the multiplicity of alloying elements and the interaction with each other, it is indeed quite surprising that a significant refinement of insoluble constituent is obtained.

Figure 3:
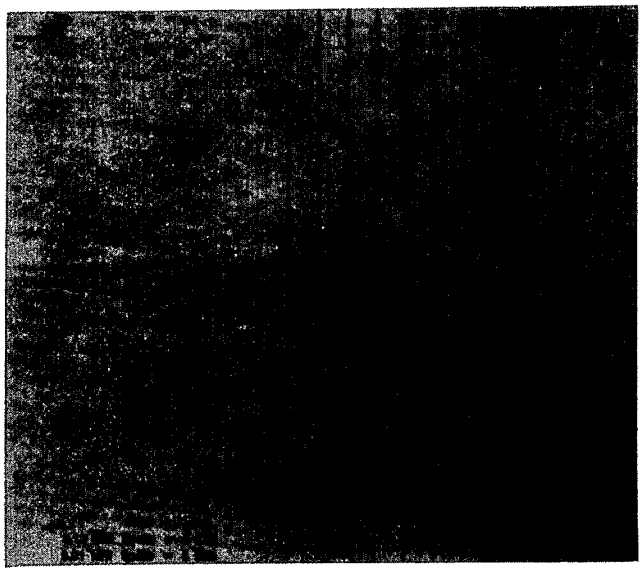
FIG. 3 is a photomicrograph (500×) of the aluminum base alloy of FIG. 2, except the sheet product is provided in a thinner gauge.

However, the benefit of adding strontium can be clearly seen by comparing the micrographs of wrought sheet products shown in FIGS. 1, 2 or 3. The compositions for these sheet products were provided hereinabove. The ingot from which these sheet products were rolled was cast by the direct chill method. An ingot having this composition was first scalped and then homogenized for 2 hours at 1050° F., and then hot rolled starting at about a temperature of 950° F. to a thickness of about 0.182 inch. From an examination of FIG. 1, it will be seen that some of the Al-Fe-Mn-Si particles or insoluble constituents are relatively large and have lengths of about 1 micron. FIG. 2 is a micrograph (500×) of an alloy having about the same composition as that shown in FIG. 1 except 0.02 wt.% strontium was added. The alloy was rolled in the same way as for the alloy of FIG. 1. It will be seen that the Al-Fe-Mn-Si particles are greatly reduced in size when compared to FIG. 1. Also, the insoluble constituents including the dispersoid phase have a substantially uniform distribution throughout the matrix. Thus, it will be observed that the strontium has the effect of refining the intermetallic phases.

Even if the sheet product of FIG. 2 is further cold rolled to 0.082 inch gauge after annealing, the small insoluble constituent or intermetallic phases are maintained. For example, FIG. 3 is a micrograph (500×) of an aluminum base alloy having the same composition and fabricated in the same way as FIG. 2, except that it was rolled to 0.082 inch gauge. It will be seen from FIG. 3 that the fine particle constituent was maintained. Thus, from these micrographs it will be seen that strontium has the effect of refining these intermetallic phases in the alloy and maintaining the refined condition after the alloy has been fabricated into a wrought sheet product, for example.

An X-ray diffraction analysis using a Guinier-type camera of the sheet samples referred to in FIGS. 1, 2 and 3 shows the relative amounts of the intermetallic phases present. The results of the analysis are tabulated in the following Table.

TABLE

| | $Mg_2Si$ | $Al_{12}(Fe_1Mn_3)Si$ | $Al_{12}(Mn_1Fe_3)Si$ | $(FeMn)Al_6$ | $FeAl_3$ | $Cr_2Al_{11}$ |
|---|---|---|---|---|---|---|
| Alloy of FIG. 1 | small+ | small+ | — | small− | very small+ | possible trace |
| Alloy of FIG. 2 | small | medium− | very small | trace | — | — |
| Alloy of | small+ | medium− | very small | very small | — | — |

TABLE-continued

| | $Mg_2Si$ | $Al_{12}(Fe_1Mn_3)Si$ | $Al_{12}(Mn_1Fe_3)Si$ | $(FeMn)Al_6$ | $FeAl_3$ | $Cr_2Al_{11}$ |
|---|---|---|---|---|---|---|
| FIG. 3 | | | | | | |

As well as providing the wrought product in compositions having controlled amounts of alloying elements as described above, it is preferred that compositions be prepared and fabricated into products according to specific method steps in order to provide the most desirable characteristics. Thus, the alloys described herein can be provided as an ingot or billet or can be strip cast for fabrication into a suitable wrought product by techniques currently employed in the art. The cast material, such as the ingot, may be preliminarily worked or shaped to provide suitable stock for subsequent working operations. In certain instances, prior to the principal working operation, the alloy stock may be subjected to homogenization treatment and preferably at metal temperatures in the range of 800° F. to 1100° F. for a time period of at least 1 hour to dissolve magnesium or other soluble elements and to homogenize the internal structure of the metal and in some cases to precipitate dispersoids. A preferred time period is 2 hours or more at the homogenization temperature. Normally, for ingot the heatup and homogenizing treatment do not have to extend for more than 24 hours; however, longer times are not normally detrimental. A soak time of 1 to 12 hours at the homogenization temperature has been found quite suitable.

After the homogenizing treatment, the metal can be rolled or extruded or otherwise subjected to working operations to produce stock such as plate, sheet, extrusion or wire or other stock suitable for shaping into the end product. To produce a sheet-type product, a body of the alloy is preferably hot rolled to a thickness in the range of about 0.125 to 0.25 inch. For hot rolling purposes, the temperature should be in the range of 600° F. to about 1050° F. and preferably the temperature initially is in the range of 850° F. to 950° F., and the temperature at completion is preferably 400° F. to 600° F.

When the intended use of a selected composition is a typical wrought sheet product such as is suitable for memory disc substrates, for example, final reduction as by cold rolling can be provided. Such reduction can be to sheet thicknesses in the range of 0.058 to 0.162 inch. The disc substrates may then be stamped for the sheet and thermally flattened at a temperature in the range of 350° F. to 750°F. for a period of time of 1 to 5 hours with a typical flattening treatment being 3 to 4 hours at 425° F. to 650° F. under pressure. The substrates are usually rough cut and then precision machined to remove about 0.006 inch in order to obtain the proper degree of flatness and smoothness before applying the memory medium. After machining it may be desirable to thermally flatten the substrates again. In addition, after machining, normally the substrates should be degreased and given a light etching treatment. Prior to applying the memory medium, the substrates may be given a chemical conversion treatment, particularly if the iron oxide-type memory medium is used.

In certain applications, depending on the properties required, it may be desirable to subject the product after working to a thermal treatment. This treatment may be provided as an intermediate anneal or after the product has been worked to final dimensions. For a partial anneal, the temperature is usually in the range of 200° F. to 500° F. with a typical range being about 300° F. to 500° F. for time periods in the range of about 1 to 4 hours. For full anneal, generally the temperature is in the range of 600° F. to 775° F. for most applications with typical annealing practices normally being in the range of 650° F. to 750° F. For full anneal, time at annealing temperature is in the range of 1 to 2 hours for batch material.

When the intended use of the wrought product in accordance with the invention is screen wire, for example, preferably the alloy consists essentially of 4 to 5.6 wt.% Mg, 0.05 to 0.2 wt.% Mn, 0.05 to 0.2 wt.% Cr, not less than 0.005 wt.% Sr, 0.4 wt.% max. Si, 0.4 wt.% max. Fe, 0.1 wt.% max. Cr, 0.25 wt.% max. Zn, the remainder aluminum and incidental impurities. Additional impurities should not constitute more than 0.15 wt.% total. When the intended use of the wrought sheet product is truck body panels and the like, for example, the alloy can consist essentially of 2.2 to 2.8 wt.% Mg, 0.1 wt.% max. Mn, 0.15 to 0.35 wt.% Cr, 0.005 to 0.25 wt.% Sr, 0.25 wt.% max. Si, 0.4 wt.% max. Fe, 0.1 wt.% max. of both Cu and Zn, the balance aluminum and impurities, the total of impurities not exceeding 0.15 wt.%. In instances where higher strengths may be required, such as in tank cars and the like, while maintaining weldability and formability, manganese may be increased in the latter alloy to be in the range of 0.5 to 1 wt.%. Likewise, where high degrees of strength are required, such as in armor plate or in liquefied natural gas containers, magnesium can be increased to be in the range of 4 to 4.9 wt.%.

While the invention has been described in terms of preferred embodiments, the claims appended hereto are intended to encompass other embodiments which fall within the spirit of the invention.

What is claimed is:

1. A wrought aluminum alloy product, the alloy consisting essentially of 0.5 to 10 wt.% Mg, about 0.2 to 1.6 wt.% Mn, 0 to 0.35 wt.% Cr, 0.005 to wt.% Sr, 0.04 to 1 wt.% Fe, 1 wt.% max. Si, 3.5 wt.% max. Zn, 1 wt.% max. Cu, 0.3 wt.% max. Ti, the remainder aluminum and incidental impurities, the product being characterized by the presence of at least one intermetallic phase of the type containing Al-Fe-Si, Al-Fe-Mn and Al-Fe-Mn-Si, wherein at least one of such phases is refined.

2. The product in accordance with claim 1 wherein Mg is maintained in the range of 0.5 to 5.6 wt.%.

3. The product in accordance with claim 1 wherein Mg is maintained in the range of 3.5 to 4.5 wt.%.

4. The product in accordance with claim 1 wherein Mn is maintained in the range of 0.2 to 0.8 wt.%.

5. The product in accordance with claim 1 wherein Mn is less than 1 wt.%.

6. The product in accordance with claim 1 wherein Cr is less than 0.25 wt.%.

7. The product in accordance with claim 1 wherein Fe is less than 0.8 wt.%.

8. The product in accordance with claim 1 wherein Fe is less than 0.5 wt.%.

9. The product in accordance with claim 1 wherein Ti is less than 0.3 wt.%.

10. The product in accordance with claim 1 wherein Si is less than 0.5 wt.%.

11. The product in accordance with claim 1 wherein Si is less than 0.35 wt.%.

12. The product in accordance with claim 1 wherein Sr is maintained in the range of 0.005 to 0.5 wt.%.

13. The product in accordance with claim 1 wherein Sr is maintained in the range of 0.01 to 0.25 wt.%.

14. A wrought aluminum alloy product, the alloy consisting essentially of 0.5 to 5.6 wt.% Mg, about 0.2 to 1.8 wt.% Mn, 0.25 wt.% max. Cr, 0.005 to 0.5 wt.% Sr, 0.04 to 0.5 wt.% Fe, 0.3 wt.% max. Ti, 0.5 wt.% max. Si, 3.5 wt.% max. Zn, 1 wt.% max. Cu, the remainder aluminum and incidental impurities, the product being characterized by the presence of at least one intermetallic phase of the type containing Al-Fe-Si, Al-Fe-Mn and Al-Fe-Mn-Si, wherein at least one of such phases is refined.

15. An aluminum alloy flat rolled product, the product consisting essentially of 0.5 to 10 wt.% Mg, about 0.2 to 1.6 wt.% Mn, 0 to 0.35 wt.% Cr, 0.005 to 0.5 wt.% Sr, 0.04 to 1 wt.% Fe, 1 wt.% max. Si, 3.5 wt.% max. Zn, 1 wt.% max. Cu, the remainder aluminum and incidental impurities, the product being characterized by the presence of at least one intermetallic phase of the type containing Al-Fe-Si, Al-Fe-Mn and Al-Fe-Mn-Si, wherein at least one of such phases is refined.

16. The product in accordance with claim 15 consisting essentially of 2.2 to 5.6 wt.% Mg, 0.1 to 1 wt.% Mn, 0 to 0.35 wt.% Cr, 0.005 to 0.5 wt.% Sr, 0.25 wt.% max. Si, 0.4 wt.% max. Fe, 0.1 wt.% max. of both Cu and Zn, the balance aluminum and impurities, the total of impurities not exceeding 0.15 wt.%.

17. The product in accordance with claim 15 wherein said product is sheet.

18. A wrought aluminum alloy sheet product suitable for machining and using as substrates, including memory disc substrates, the product consisting of 0.5 to 10 wt.% Mg, about 0.2 to 1.4 wt.% Mn, 0 to 0.35 wt.% Cr, 0.005 to 0 wt.% Sr, 0.04 to 1 wt.% Fe, 1 wt.% max. Si, 3.5 wt.% max. Zn, 1 wt.% max. Cu, the remainder aluminum and incidental impurities, the product characterized by the presence of at least one intermetallic phase of the type containing Al-Fe-Si, Al-Fe-Mn and Al-Fe-Mn-Si, wherein one of such phases is refined.

19. The product in accordance with claim 18 wherein Mg is in the range of 0.5 to 5.6 wt.%.

20. The product in accordance with claim 18 wherein Mg is in the range of 3.5 to 4.5 wt.%.

21. The product in accordance with claim 18 wherein Mn is in the range of 0.2 to 0.8 wt.%.

22. The product in accordance with claim 18 wherein Mn is less than 1 wt.%.

23. The product in accordance with claim 18 wherein Cr is in the range of 0.05 to 0.25 wt.%.

24. The product in accordance with claim 18 wherein Fe is less than 0.5 wt.%.

25. The product in accordance with claim 18 wherein Zn is less than 0.25 wt.%.

26. The product in accordance with claim 18 wherein Ti is less than 0.15 wt.%.

27. The product in accordance with claim 18 wherein Sr is in the range of 0.005 to 0.5 wt.%.

28. The product in accordance with claim 18 wherein Si is less than 0.35 wt.%.

29. A wrought aluminum alloy sheet product suitable for machining and using as a memory disc substrate, the product consisting essentially of 3.5 to 4.5 wt.% Mg, 0.1 to 1 wt.% Mn, 0.35 wt.% max. Cr, 0.005 to 0.5 wt.% Sr, 0.04 to 0.5 wt.% Fe, 0.35 wt.% max. Si, 0.25 wt.% max. each of Zn, Cu and Ti, the remainder aluminum and impurities, the product characterized by the presence of at least one intermetallic phase of the type consisting of Al-Fe-Si, Al-Fe-Mn and Al-Fe-Mn-Si, wherein one of such phases is refined.

30. A memory disc substrate consisting essentially of about 3.5 to 4.5 wt.% Mn, 0.1 to 1 wt.% Mn, 0.35 wt.% max. Cr, 0.005 to 0.5 wt.% Sr, 0.04 to 0.5 wt.% Fe, 0.35 wt.% max. Si, 0.25 wt.% max. each of Zn, Cu and Ti, the remainder aluminum and impurities, the product characterized by the presence of at least one intermetallic phase of the type consisting of Al-Fe-Si, Al-Fe-Mn and Al-Fe-Mn-Si, wherein one of such phases is refined.

31. A memory disc comprised of an aluminum alloy substrate, (a) the alloy consisting essentially of 0.5 to 5.6 wt.% Mg, 1 wt.% max. Mn, 0 to 0.35 wt.% Cr, 0.005 to 0.5 wt.% Sr, 0.04 to 1 wt.% Fe and less than 1.0 wt% Si, 3.5 wt.% max. Zn, the remainder aluminum and impurities, the substrate characterized by the presence of at least one intermetallic phase of the type containing Al-Fe-Si, Al-Fe-Mn and Al-Fe-Mn-Si, wherein at least one of such phases is refined, and (b) a layer of memory medium provided on said substrate.

32. The substrate in accordance with claim 31 wherein the alloy consists essentially of 3.5 to 4.5 wt.% Mg, 0.1 to 1 wt.% Mn, 0.35 wt.% Cr, 0.005 to 0.5 wt.% Sr, 0.5 wt.% max. Fe, 0.35 wt.% max. Si, 1 wt.% max. of both Cu and Zn, 0.25 wt.% max. Ti, the remainder aluminum and impurities.

33. The memory medium in accordance with claim 31 wherein the memory medium is comprised of a thin metallic layer.

34. The memory medium in accordance with claim 31 wherein the memory medium is comprised of iron oxide suspended in a plastic carrier.

35. The method of producing a wrought aluminum alloy product, comprising the steps of:

(a) providing a body of aluminum base alloy consisting essentially of 2.2 to 10 wt.% Mg, 0.1 to 1.4 wt.% Mn, 0 to 0.35 wt.% Cr, 0.005 to 0 wt.% Sr, 0.04 to 1 wt.% Fe, 1 wt.% max. Si, 3.5 wt.% max, Zn, 1 wt.% max. Cu, 0.3 wt.% max. Ti, the remainder aluminum and incidental impurities, (b) heating the body to a temperature of not greater than 1100° F., and (c) working said body to produce a wrought aluminum alloy product being characterized by the presence of at least one intermetallic phase of the type containing Al-Fe-Si, Al-Fe-Mn and Al-Fe-Mn-Si, wherein at least one of such phases is refined.

36. The method in accordance with claim 35 wherein Mg is maintained in the range of 2.2 to 5.6 wt.%.

37. The method in accordance with claim 35 wherein Mg is maintained in the range of 3.5 to 4.5 wt.%.

38. The method in accordance with claim 35 wherein Mn is maintained in the range of 0.2 to 0.8 wt.%.

39. The method in accordance with claim 35 wherein Mn is less than 1 wt.%.

40. The method in accordance with claim 35 wherein Cr is less than 0.25 wt.%.

41. The method in accordance with claim 35 wherein Fe is less than 0.8 wt.%.

42. The method in accordance with claim 35 wherein Fe is less than 0.5 wt.%.

43. The method in accordance with claim 35 wherein Ti is less than 0.3 wt.%.

44. The method in accordance with claim 35 wherein Si is less than 0.5 wt.%.

45. The method in accordance with claim 35 wherein Si is less than 0.35 wt.%.

46. The method in accordance with claim 35 wherein Sr is maintained in the range of 0.005 to 0.5 wt.%.

47. The method in accordance with claim 35 wherein Sr is maintained in the range of 0.01 to 0.25 wt.%.

48. A method of producing a wrought aluminum alloy product, comprising the steps of:

(a) providing a body of aluminum base alloy consisting essentially of 0.5 to 5.6 wt.% Mg, about 0.2 to 1.8 wt.% Mn, 0.25 wt.% max. Cr, 0.005 to 0.5 wt.% Sr, 0.04 to 0.5 wt.% Fe, 0.3 wt.% max. Ti, 0.5 wt.% max. Si, 3.5 wt.% max. Zn, 1 wt.% max. Cu, the remainder aluminum and incidental impurities, (b) heating the body to a temperature of not greater than 1100° F., and (c) working said body to produce a wrought aluminum alloy product being characterized by the presence of at least one intermetallic phase of the type containing Al-Fe-Si, Al-Fe-Mn and Al-Fe-Mn-Si, wherein at least one of such phases is refined.

49. A method of producing an aluminum alloy flat rolled product, the method comprising the steps of:

(a) providing a body of an aluminum base alloy consisting essentially of 0.5 to 10 wt.% Mg, about 0.2 to 1.6 wt.% Mn, 0 to 0.35 wt.% Cr, 0.005 to 0.5 wt.% Sr, 0.04 to 1 wt.% Fe, 1 wt.% max. Si, 3.5 wt.% max. Zn, 1 wt.% max. Cu, the remainder aluminum and incidental impurities, (b) heating the body to a temperature of not greater than 1100° F., and (c) hot rolling said body to produce a flat rolled product being characterized by the presence of at least one intermetallic phase of the type containing Al-Fe-Si, Al-Fe-Mn and Al-Fe-Mn-Si, wherein at least one of such phases is refined.

50. The method in accordance with claim 49 consisting essentially of 2.2 to 5.6 wt.% Mg, 0.1 to 1 wt.% Mn, 0 to 0.35 wt.% Cr, 0.005 to 0.5 wt.% Sr, 0.25 wt.% max. Si, 0.4 wt.% max. Fe, 0.1 wt.% max. of both Cu and Zn, the balance aluminum and impurities, the total of impurities not exceeding 0.15 wt.%.

51. The method in accordance with claim 49 wherein said product is sheet.

52. A method of producing a wrought aluminum alloy sheet product suitable for machining and using as substrates, including memory disc substrates, the method comprising the steps of:

(a) providing a body of an aluminum base alloy consisting of 0.5 to 10 wt.% Mg, about 0.2 to 1.4 wt.% Mn, 0 to 0.35 wt.% Cr, 0.005 to 0 wt.% Sr, 0.04 to 1 wt.% Fe, 1 wt.% max. Si, 3.5 wt.% max. Zn, 1 wt.% max. Cu, the remainder aluminum and incidental impurities, (b) heating the body to a temperature of not greater than 1100° F., and (c) hot rolling said body to produce a wrought aluminum alloy sheet product characterized by the presence of at least one intermetallic phase of the type containing Al-Fe-Si, Al-Fe-Mn and Al-Fe-Mn-Si, wherein one of such phases is refined.

53. The method in accordance with claim 52 wherein Mg is in the range of 0.5 to 5.6 wt.%.

54. The method in accordance with claim 52 wherein Mg is in the range of 3.5 to 4.5 wt.%.

55. The method in accordance with claim 52 wherein Mn is in the range of 0.2 to 0.8 wt.%.

56. The method in accordance with claim 52 wherein Mn is less than 1 wt.%.

57. The method in accordance with claim 52 wherein Cr is in the range of 0.05 to 0.25 wt.%.

58. The method in accordance with claim 52 wherein Fe is less than 0.5 wt.%.

59. The method in accordance with claim 52 wherein Zn is less than 0.25 wt.%.

60. The method in accordance with claim 52 wherein Ti is less than 0.15 wt.%.

61. The method in accordance with claim 52 wherein Sr is in the range of 0.005 to 0.5 wt.%.

62. The method in accordance with claim 52 wherein Si is less than 0.35 wt.%.

63. A method of producing a wrought aluminum alloy sheet product suitable for machining and using as memory disc substrate, the method comprising the steps of:

(a) providing a body of an aluminum base alloy consisting essentially of 3.5 to 4.5 wt.% Mg, 0.1 to 1 wt.% Mn, 0.35 wt.% max. Cr, 0.005 to 0.5 wt.% Sr, 0.04 to 0.5 wt.% Fe, 0.35 wt.% max. Si, 0.25 wt.% max. each of Zn, Cu and Ti, the remainder aluminum and impurities, (b) heating the body to a temperature of not greater than 1100° F., and (c) hot rolling said body to produce a sheet product characterized by the presence of at least one intermetallic phase of the type consisting of Al-Fe-Si, Al-Fe-Mn and Al-Fe-Mn-Si, wherein one of such phases is refined.

64. A method of producing a memory disc comprised of an aluminum alloy substrate and a layer of memory medium, the method comprising the steps of:

(a) providing a body of an aluminum base alloy consisting essentially of 0.5 to 5.6 wt.% Mg, 1 wt.% max. Mn, 0 to 0.35 wt.% Cr, 0.005 to 0.5 wt.% Sr, 0.04 to 1 wt.% Fe and less than 1.0 wt.% Si, 3.5 wt.% max. Zn, the remainder aluminum and impurities, (b) heating the body to a temperature of not greater than 1100° F., (c) rolling said body to a sheet product, with said rolling being completed at a temperature in the range of 400° F. to 600° F., (d) cold rolling the sheet product to a final gauge, the sheet characterized by the presence of at least one intermetallic phase of the type containing Al-Fe-Si, Al-Fe-Mn and Al-Fe-Mn-Si, wherein at least one of such phases is refined, (e) stamping a memory disc substrate from said cold rolled sheet, (f) machining said substrate to provide a smooth surface thereon, said (g) depositing a layer of memory medium on said substrate to provide the memory disc.

65. The substrate in accordance with claim 64 wherein the alloy consists essentially of 3.5 to 4.5 wt.% Mg, 0.1 to 1 wt.% Mn, 0.35 wt.% Cr, 0.005 to 0.5 wt.% Sr, 0.5 wt.% max. Fe, 0.35 wt.% max. Si, 1 wt.% max. of both Cu and Zn, 0.25 wt.% max. Ti, the remainder aluminum and impurities.

66. The memory medium in accordance with claim 64 wherein the memory medium is comprised of a thin metallic layer.

67. The memory medium in accordance with claim 64 wherein the memory medium is comprised of iron oxide suspended in a plastic carrier.

68. The method in accordance with claim 64 wherein the body is rolled at a temperature in the range of 600° F. to 1050° F.

69. The method in accordance with claim 64 wherein the body is rolled at a temperature in the range of 750° F. to 950° F. with said hot rolling being completed at a temperature in the range of 400° F. to 600° F.

70. The method in accordance with claim 64 wherein the body is subjected to a homogenization treatment prior to said hot rolling step, said treatment being at a temperature of 900° F. to 1100° F. for a period of at least 1 hour.

71. The method in accordance with claim 64 wherein the body is hot rolled to a gauge in the range of 0.125 to 0.25 inch.

72. The method in accordance with claim 64 wherein the product is cold rolled to a gauge in the range of 0.058 to 0.162 inch.

73. The method in accordance with claim 64 including thermally flattening said substrates at a temperature in the range of 420° F. to 750° F. for a period of time in the range of 1 to 5 hours.

74. A method of producing a memory disc having a substrate of an aluminum base alloy and a layer of memory medium thereon, the method comprising the steps of:

(a) providing a body of an aluminum base alloy consisting essentially of 3.5 to 4.5 wt.% Mg, 0.1 to 1 wt.% Mn, 0.35 wt.% max. Cr, 0.005 to 0.5 wt.% Sr, 0.04 to 0.5 wt.% Fe, 0.35 wt.% max. Si, 0.25 wt.% max. each of Zn, Cu and ti, the remainder aluminum and impurities, (b) subjecting said body to a homogenization treatment at a temperature in the range of 900° F. to 1100° F. for a period of at least 2 hours, (c) thereafter rolling said body at a temperature in the range of 750° F. to 950° F. with said rolling being completed at a temperature in the range of 400° F. to 600° F., said rolling being to a gauge in the range of 0.125 to 0.25 inch, (d) cold rolling the hot rolled product to a sheet product having a gauge in the range of 0.058 to 0.162 inch, (e) stamping memory disc substrates from said sheet product and subjecting the substrate to a thermal flattening treatment at a temperature in the range of 425° F. to 750° F. for a period of 1 to 5 hours, (f) machining the substrate to a smooth surface, and (g) after cleaning the surface of the substrate, providing a layer of memory medium thereon.

* * * * *

UNITED STATES PATENT AND TRADEMARK OFFICE

CERTIFICATE OF CORRECTION

PATENT NO. : 4,412,870

DATED : November 1, 1983

INVENTOR(S) : W. D. Vernam et al

It is certified that error appears in the above-identified patent and that said Letters Patent is hereby corrected as shown below:

| | |
|---|---|
| Col. 1, line 5 | Insert --Introduction-- as a subheading. |
| Col. 5, line 17 | Change "B1" to --1--. |
| Col. 8, line 44, (Claim 1) | After "0.005 to" insert --0.5--. |
| Col. 9, line 38 (Claim 18) | After "0.005 to" change "0" to --0.5--. |
| Col. 10, line 43 (Claim 35) | After "essentially of" insert --about--. |
| Col. 10, line 43 (Claim 35) | After "0.005 to" change "0" to --0.5--. |
| Col. 10, line 56 (Claim 36) | After "of" insert --about--. |
| Col. 11, line 56 (Claim 52) | After "0.005 to" change "0" to --0.5--. |

UNITED STATES PATENT AND TRADEMARK OFFICE

CERTIFICATE OF CORRECTION

PATENT NO. : 4,412,870

DATED : November 1, 1983

INVENTOR(S) : W. D. Vernam et al

It is certified that error appears in the above-identified patent and that said Letters Patent is hereby corrected as shown below:

Col. 12, line 60 (Claim 64) Change "said" to --and--.

Col. 14, line 9 (Claim 74) Change "ti" to --Ti--.

Signed and Sealed this

*Fifth* Day of *June 1984*

[SEAL]

*Attest:*

GERALD J. MOSSINGHOFF

*Attesting Officer*

*Commissioner of Patents and Trademarks*